US006145135A

United States Patent [19]

Pool et al.

[11] Patent Number: 6,145,135

[45] Date of Patent: Nov. 14, 2000

[54] HELICAL DRAIN PLUNGER

[75] Inventors: Dan B. Pool; David F. Kreitzer, both of Phoenix, Ariz.

[73] Assignee: Equity Earnings Corp. DBA Designer Products, Phoenix, Ariz.

[21] Appl. No.: 09/447,880

[22] Filed: Nov. 23, 1999

Related U.S. Application Data

[60] Provisional application No. 60/109,900, Nov. 25, 1998.

[51] Int. Cl.[7] ..... E03D 9/00

[52] U.S. Cl. ..... 4/255.09; 4/255.11

[58] Field of Search ..... 4/255.05, 255.09, 4/255.11, 255.12; D32/35

[56] References Cited

U.S. PATENT DOCUMENTS

D. 364,251 11/1995 Novak ..... D32/35
D. 381,146 7/1997 Tash .
D. 381,147 7/1997 Tash .
D. 385,073 10/1997 Tash .
1,588,320 6/1926 Komarcsevits ..... 4/255.09
4,745,641 5/1988 Tash .

*Primary Examiner*—Charles E. Phillips
*Attorney, Agent, or Firm*—Parsons & Goltry; Robert A. Parsons; Michael W. Goltry

[57] ABSTRACT

A drain plunger including an elongate handle having a first end and a second end. A generally cylindrical chamber having a continuous side wall defining a void and having a first end coupled to the handle. A second end of the chamber forms a nozzle defining an opening in communication with the void. The side wall including a spiral pleat encircling the void and movable between a compressed position and an expanded position for imparting a vortex motion to water drawn through and expelled through the nozzle.

16 Claims, 8 Drawing Sheets

HELICAL DRAIN PLUNGER

This application claims the benefit of U.S. Provisional Application No. 60/109,900, filed 25 Nov. 1998.

FIELD OF INVENTION

The present invention relates to a drain plunger, and in particular, to an improved drain plunger.

BACKGROUND OF INVENTION AND BRIEF DESCRIPTION OF THE PRIOR ART

Plunger devices having a bellows coupled to a hollow handle exist in the prior art. Typically, these plunger devices provide a relatively large bellows to force a relatively large volume of air/water into a drain to remove a clog. The large bellows has multiple pleats that allow the large bellows to be compressed or collapsed to force the air/water into the drain.

An example of a plunger device having a multiply-pleated bellows coupled to a hollow handle is disclosed in U.S Pat. No. 4,745,641. This prior art patent is incorporated by reference herein.

A problem with a prior art plunger that has relatively large and multiply-pleated bellows is that when such a plunger is initially inserted into a toilet bowl or basin that is full or nearly full of water or other liquid (i.e. nearly overflowing with liquid because of a clogged drain opening), a relatively large volume of the liquid is caused to be displaced and therefore the liquid may overflow out of the bowl or basin. A large volume of liquid is displaced by the air trapped in the bellows and the hollow handle when the plunger is inserted into the bowl or basin. Also, the bellows of such a plunger is relatively long and cumbersome and may not compress or collapse uniformly during use and may cause liquid and/or debris to splash out of the bowl or basin. Another problem with the prior art plungers is that a relatively large bellows forces a relatively large volume of air/water into the clogged drain area, and if the clog does not clear from the drain, liquid and/or debris may end up being forced or splashed out of the bowl.

Air vent mechanisms have been used with plungers to regulate the pressure within the plunger. U.S. Pat. No. 4,745,641 discloses an example of such an air vent mechanism that has a screw cap handle. However, air vent mechanisms for preventing overflow or displacement of liquid from a bowl or basin when the plunger is being initially inserted into the bowl or basin have not been explicitly taught or disclosed by the prior art, and such a mechanism is certainly needed and desired. A further problem with the prior art plungers is that debris from the bowl or basin may become lodged or trapped within the pleats of the multiply-pleated bellows thereby causing an unsanitary condition and complicating the clean-up process.

Also, prior art plungers typically provide a generally linear force of air/liquid to and from the clog. Therefore, these prior art plungers are limited to a generally singular direction of force to and from that clog. A plunger that provides multi-directional forces that act upon a clog would certainly be more effective and is certainly needed and desired.

Therefore, the present invention discloses and provides an improved drain plunger that has features which provide further convenience and improved and cleaner usage for the user and overcome the above problems, disadvantages, and limitations of the prior art.

SUMMARY OF INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide an improved drain plunger.

It is another object of the invention to provide a plunger that is generally more compact and smaller and/or slimmer in design.

It is another object of the invention to provide an improved drain plunger that prevents overflow or excessive displacement of liquid when the plunger is initially inserted into a clogged bowl, basin, or drain area.

It is a further object of the invention to provide an improved drain plunger that prevents splashing or sloshing of the liquid when the plunger is being used.

It is another object of the invention to provide an improved drain plunger that compresses and expands neatly and more evenly when the plunger is being used.

It is a further object of the invention to provide an improved drain plunger that minimizes or reduces the amount of debris trapped therein.

It is a further object of the invention to provide an improved drain plunger that is cleaner and more sanitary to use and store.

It is another object of the invention to provide an improved drain plunger that provides multiple or additional directions of forces directed at a clog to aid in more effectively unclogging a clog.

The above objects and advantages are achieved by a drain plunger including an elongate handle having a first end and a second end. A generally cylindrical chamber having a continuous side wall defining a void and having a first end coupled to the handle. A second end of the chamber forms a nozzle defining an opening in communication with the void. The side wall including a spiral pleat encircling the void and movable between a compressed position and an expanded position for imparting a vortex motion to water drawn through and expelled through the nozzle.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

Figure 1:
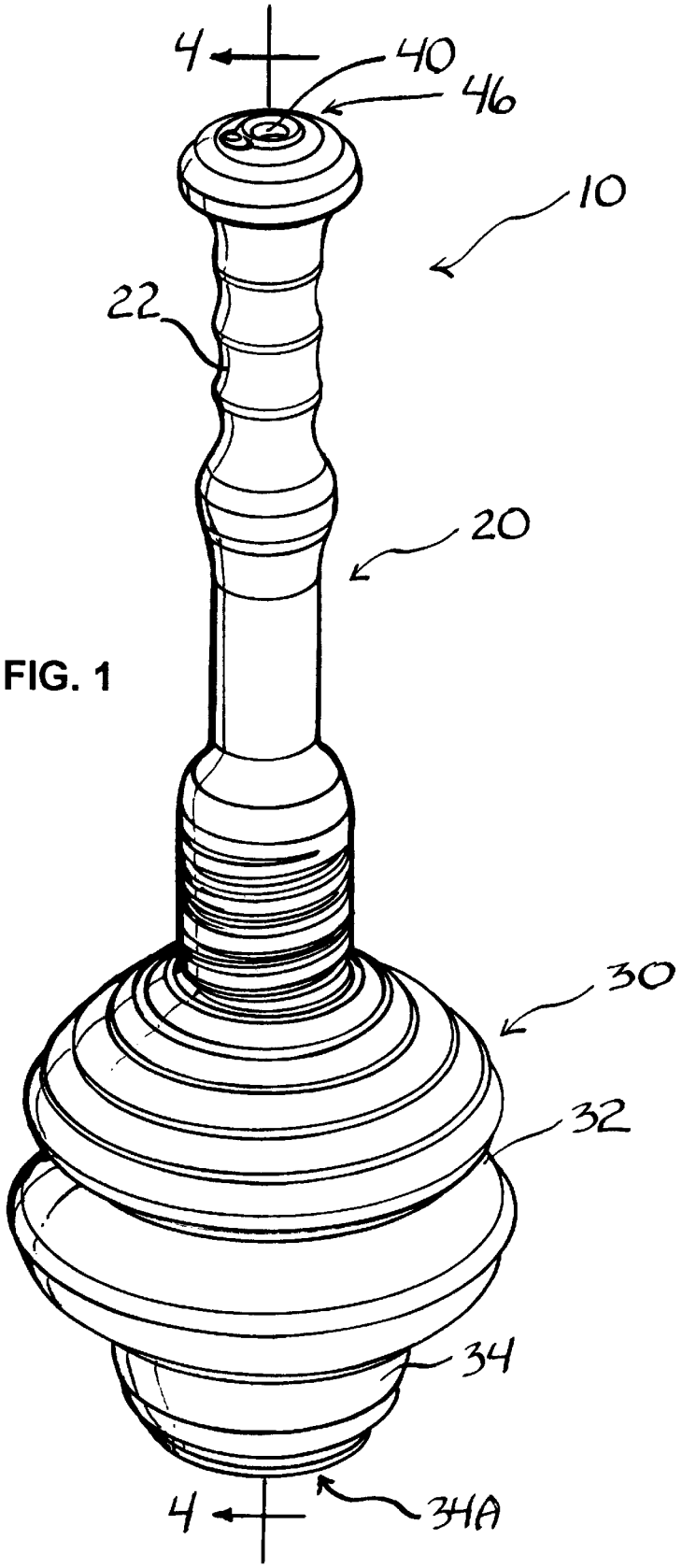
FIG. 1 is a perspective view of the present invention improved drain plunger with a preferred embodiment collapsible air chamber and a preferred embodiment air vent mechanism.

Referring to FIG. 1, the present invention discloses an improved drain plunger 10 having a hollow handle 20 that is releasably coupled, in the preferred embodiment, to a single pleated collapsible air chamber 30. The handle 20 is preferably made of a ridged plastic material and has a grip 22 molded into the handle 20. The single pleated collapsible air chamber 30 is generally cylindrical and hollow and is made of a resilient, flexible plastic material. A single pleat 32 is molded into and extends entirely and uniformly around a perimeter portion of the single pleated collapsible air chamber 30 to allow the single pleated collapsible air chamber 30 to be easily compressed and expanded during use. In other words, chamber 30 includes a continuous side wall 28 defining an inner void 35 as can be seen with additional reference to FIG. 4.

Figure 2:
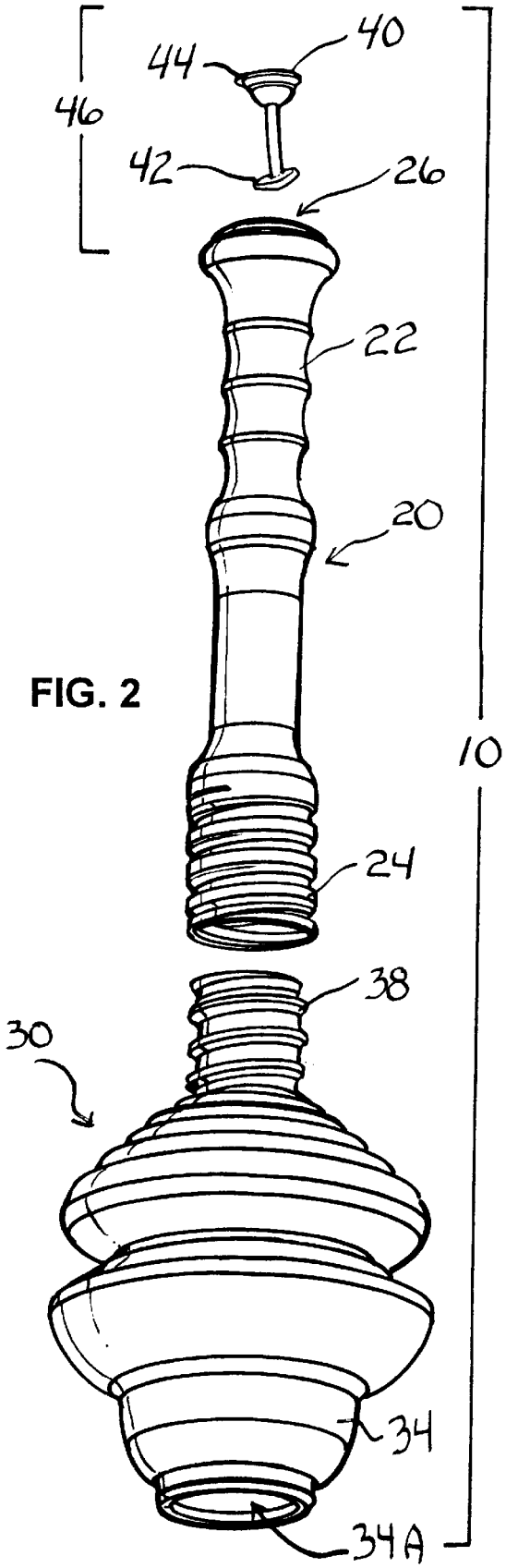
FIG. 2 is a perspective exploded view of the improved drain plunger of FIG. 1.

Referring to FIG. 2, the base of the single pleated collapsible air chamber 30 includes side wall 28 terminating in a sealing nozzle 34. Nozzle 34 defines a nozzle opening 34A in communication with void 35. Opening 34A is engageable and sealable into a drain opening of a toilet/basin or other drain openings so that the pressure/suction from the single pleated collapsible air chamber 30 is directed towards the clog within the drain. However, the sealing nozzle 34 is sufficiently resilient so that it collapses when the plunger 10 is used to unclog a drain having a flat surface opening. The single pleated collapsible air chamber 30 is relatively compact and smaller/slimmer in diameter and holds a relatively low volume of air/liquid thereby preventing liquid and/or debris from being displaced or overflowed out of the bowl. Also, since the single pleated collapsible air chamber 30 is relatively compact and has just one pleat 32, the single pleated collapsible air chamber 30 compresses and expands neatly and evenly to direct pressure and suction towards a clog without splashing or sloshing the surrounding liquid. Furthermore, since the single pleated collapsible air chamber 30 is relatively compact and slim in design, the present invention plunger 10 is easy to store. The single pleated collapsible air chamber 30 is coupled to the hollow handle 20 via a threaded portion 38 that threadingly couples to a receiving threaded portion 24 of the hollow handle 20.

Figure 3:
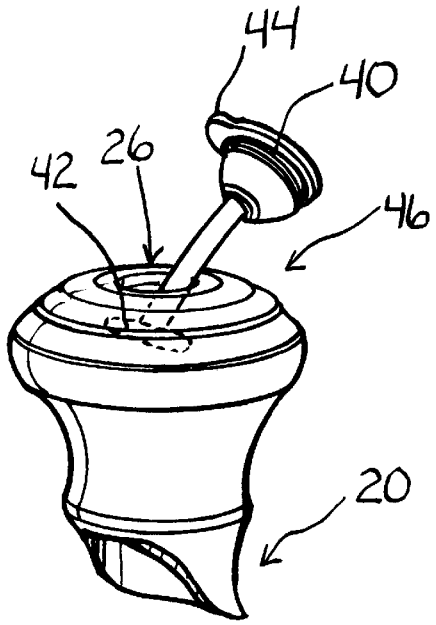
FIG. 3 is a perspective view of the preferred embodiment air vent mechanism for the improved drain plunger of FIG. 1.

Referring to FIGS. 2 and 3, a preferred embodiment air vent mechanism 46 is provided. The air vent mechanism 46 includes a vent opening 26 provided in a generally upper portion of the hollow handle 20 to allow the release of air that exists within the single pleated collapsible air chamber 30 and the hollow handle 20. The air vent mechanism 46 also includes a vent plug 40. When the plunger 10 is being initially inserted into a bowl or basin or other clogged liquid filled area, the vent plug 40 is disengaged and/or removed from the vent opening 26 to release air from the single pleated collapsible air chamber 30 and the handle 20. The release of the air and the smaller and compact structure of the single pleated collapsible air chamber 30 are provided to prevent overflow or excessive displacement of liquid when the plunger 10 is being initially inserted into the bowl or basin. If the vent plug 40 is engaged into the vent opening 26, the vent plug 40 is released from the vent opening 26 by the user gently pulling outwardly on a tab portion 44 of the vent plug 40.

After the plunger 10 is initially inserted into the bowl or basin or other clogged liquid filled area and while the vent plug 40 is still disengaged from the vent opening 26, liquid fills into at least parts of the inner portion 36 (i.e. see FIG. 4) of the air chamber 30 and/or hollow handle 20. A retaining member 42 shown in FIG. 2 projects from the vent plug 40 and fastens into the vent opening 26 to retain the vent plug 40 at or near the vent opening 26 in the hollow handle 20 as shown in FIG. 3. When the plunger 10 is being used to unclog a clogged drain, the removable vent plug 40 is positioned into and engagingly seals the vent opening 26 to prevent air and/or liquid from being released therefrom. Since the plunger 10 is filled with at least some liquid after being initially inserted therein, then liquid instead of air is being forced to the clogged area helping prevent splashing of liquid and helping provide more effective and forceful plunging.

Figure 4:
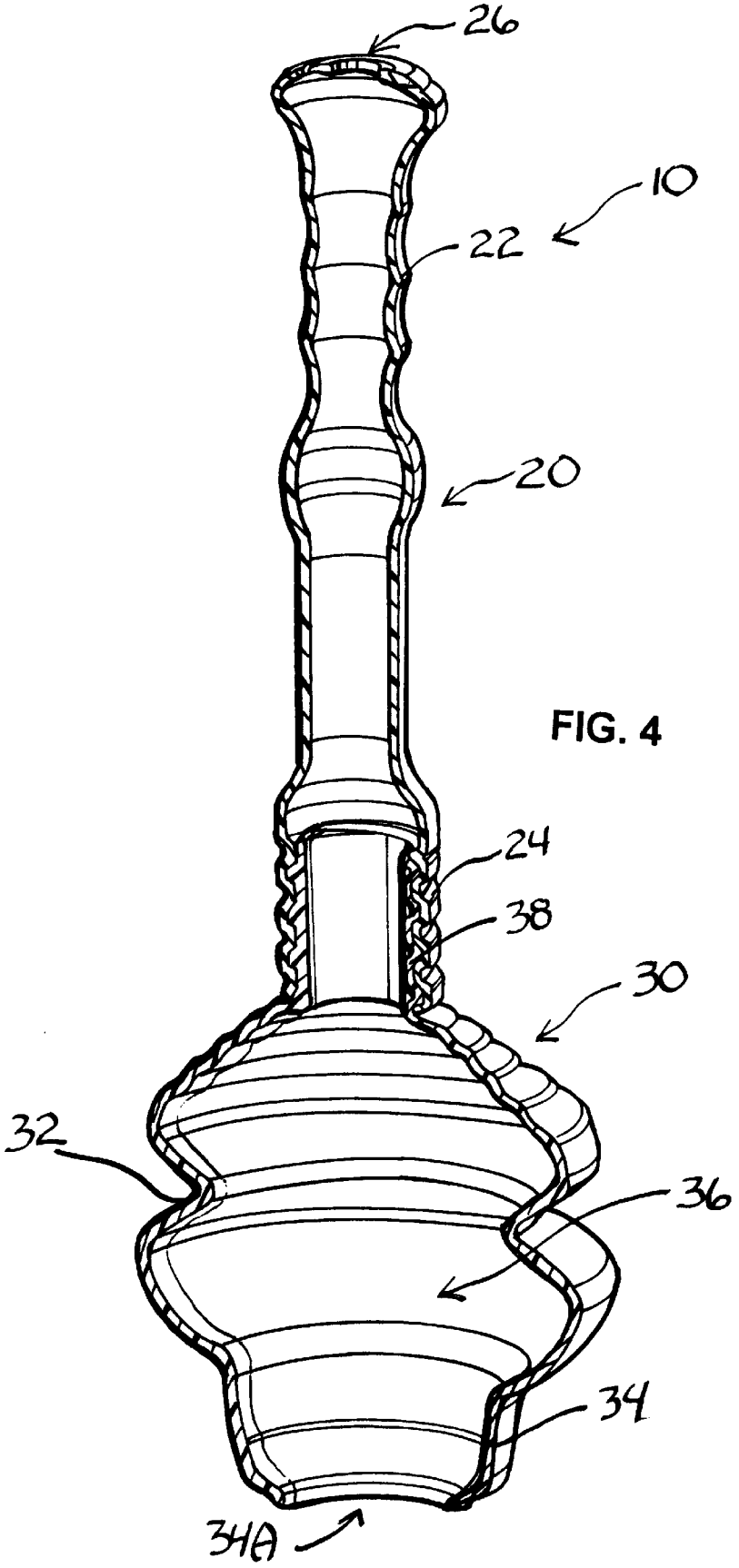
FIG. 4 is a cross-sectional view of the improved drain plunger taken along line the 4—4 of FIG. 1.

Referring to FIG. 4, since the single pleated collapsible air chamber 30 has only one single pleat 32 formed in side wall 31 and intermediate the ends thereof and encircling void 33, the inner portion 36 of the single pleated collapsible air chamber 30 is relatively free from debris trapping areas or obstructive areas that may trap debris. Therefore, unsanitary debris from a clogged drain is less likely to become trapped within the single pleated collapsible air chamber 30 of the present invention during use. Also, the plunger 10 may be disassembled (i.e. the single pleated collapsible air chamber 30 is unscrewed and detached from the hollow handle 20) for easy cleaning and/or storage.

Figure 5:
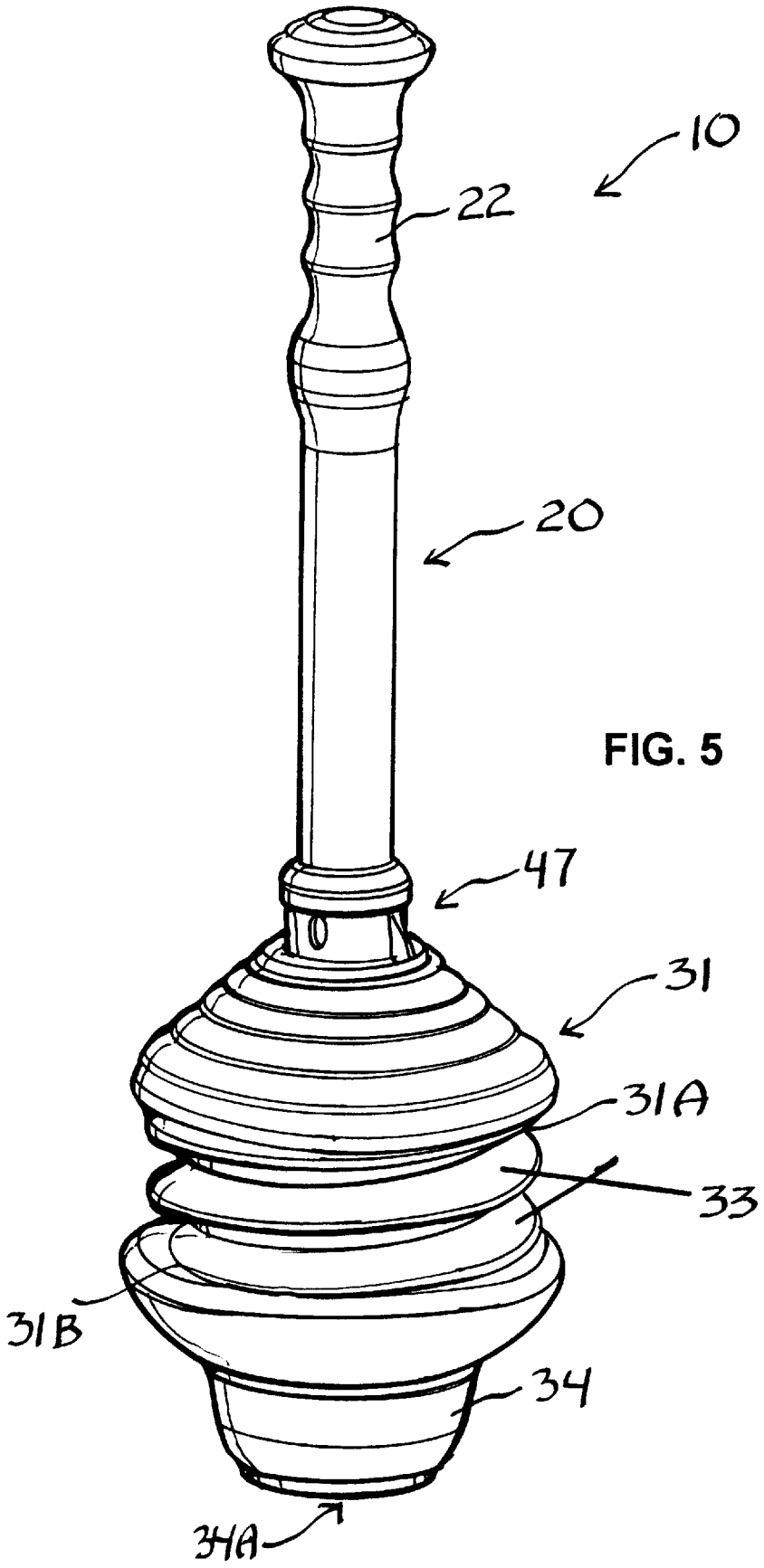
FIG. 5 is a perspective view of the present invention improved drain plunger with another preferred embodiment collapsible air chamber and another preferred embodiment air vent mechanism.

Referring to FIG. 5, the present invention further discloses an improved drain plunger 10 having a hollow handle 20 that is releasably coupled to a preferred embodiment spiral pleated collapsible air chamber 31. The handle 20 is preferably made of a rigid plastic material and has a grip 22 molded into the handle 20. The spiral pleated collapsible air chamber 31 is generally cylindrical and hollow (defining a void) and is made of a resilient, flexible plastic material. A spiral pleat 33 is molded as part of the air chamber 31 and spirals around from an upper portion 31A of the air chamber 31 to a lower portion 31B of the air chamber 31. The spiral pleat 33 allows the air chamber 31 to be easily and uniformly compressed and expanded during use (i.e. reduces wobbling and skewing of the air chamber 31 when being compressed and expanded).

Figure 6:
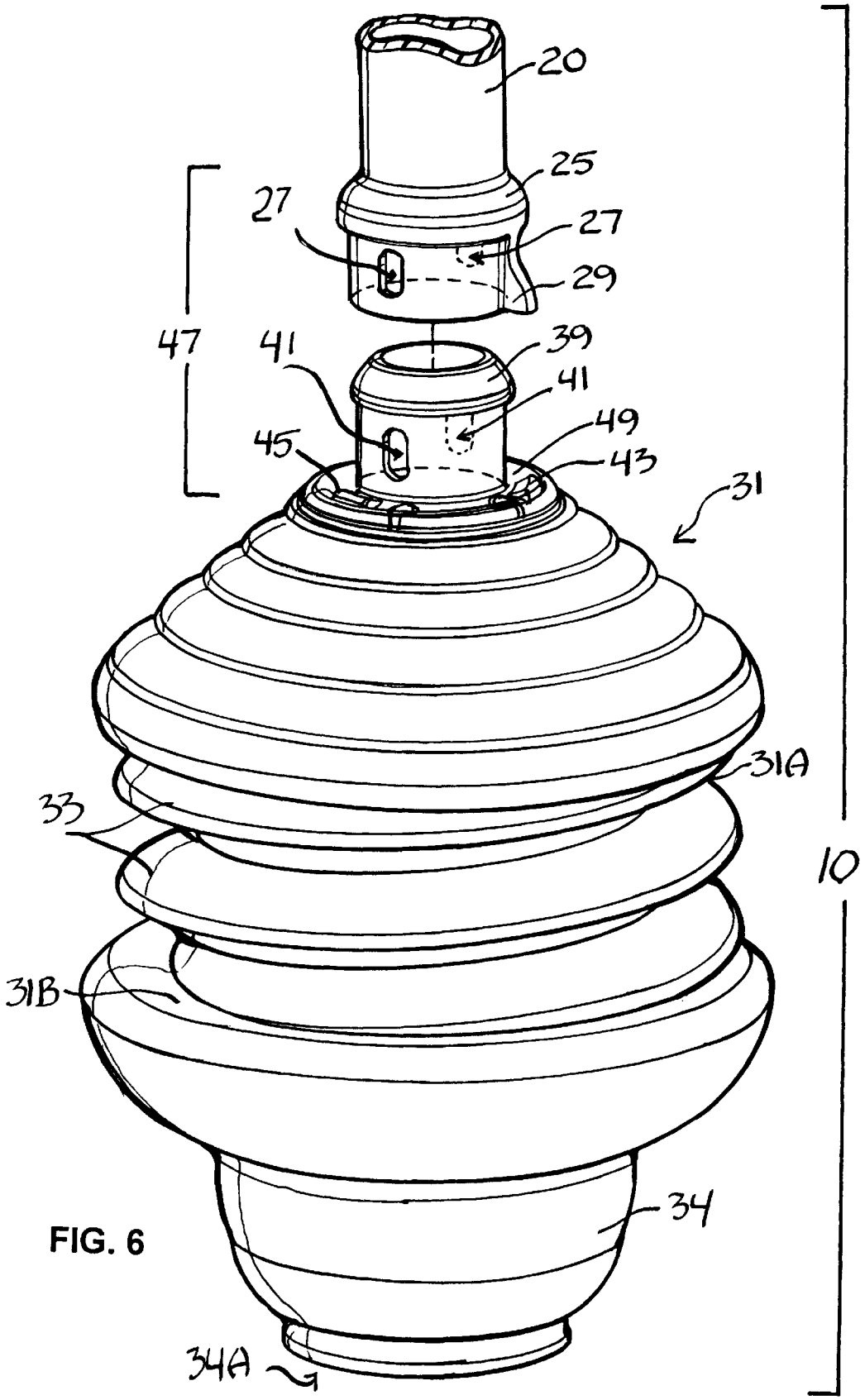
FIG. 6 is a partial perspective view of the present invention improved drain plunger of FIG. 5 showing the coupling components of the air chamber and the handle and the air vent mechanism.

Referring to FIG. 6, the base of the spiral pleated collapsible air chamber 31 has a sealing nozzle 34 defining a nozzle opening 34A that is engageable and sealable into a drain opening of a toilet/basin or other drain openings so that the pressure/suction from the spiral pleated collapsible air chamber 31 is directed towards the clog within the drain. However, the sealing nozzle 34 is sufficiently resilient so that it collapses when the plunger 10 is used to unclog a drain having a flat surface opening. The spiral pleated collapsible air chamber 31 is relatively compact and smaller in diameter and holds a relatively low volume of air/liquid thereby preventing liquid and/or debris from being displaced or overflowed out of the bowl. Also, since the spiral pleated collapsible air chamber 31 is relatively compact and has only a few spirals within the spiral pleat 33, the spiral pleated collapsible air chamber 31 compresses and expands neatly and evenly to direct pressure and suction towards a clog without splashing or sloshing the surrounding liquid. Furthermore, since the spiral pleated collapsible air chamber 31 is relatively compact and slim, the present invention plunger 10 is easy to store. The spiral pleated collapsible air chamber 31 is coupled to the hollow handle 20 via a snap fitting component 39 located above the upper portion 31A of the air chamber 31. A snap fitting receiver 25 is located at a base end of the hollow handle 20. The snap fitting receiver 25 is coupled over and fittingly snaps to the snap fitting component 39 so that the hollow handle 20 and air chamber 31 are coupled together so that they are secure but still allow rotational movement of the handle 20 relative to the air chamber 31.

Figure 7:
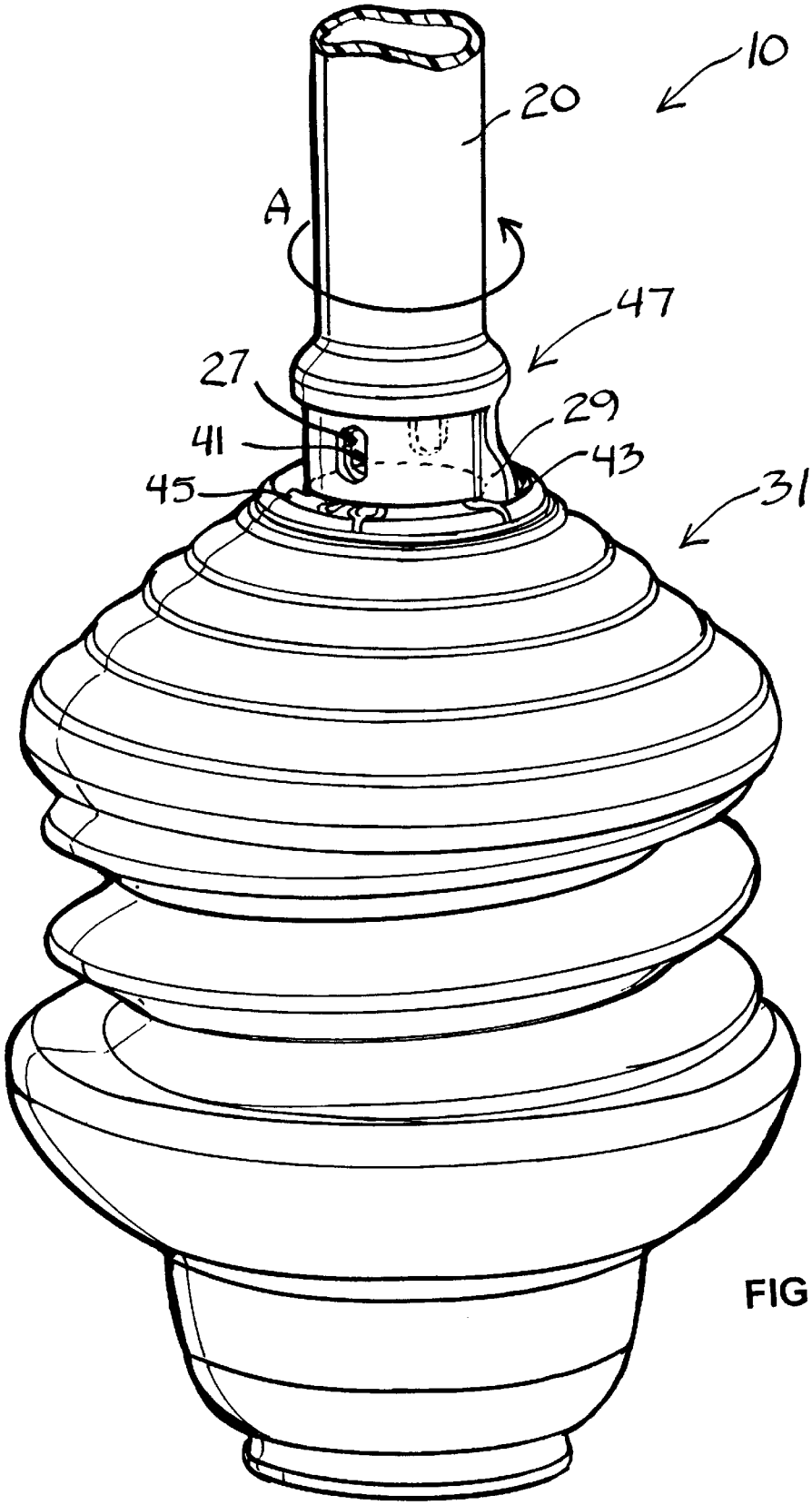
FIG. 7 is a partial perspective view of the present invention improved drain plunger showing the air vent mechanism in an air vent open position.
Figure 8:
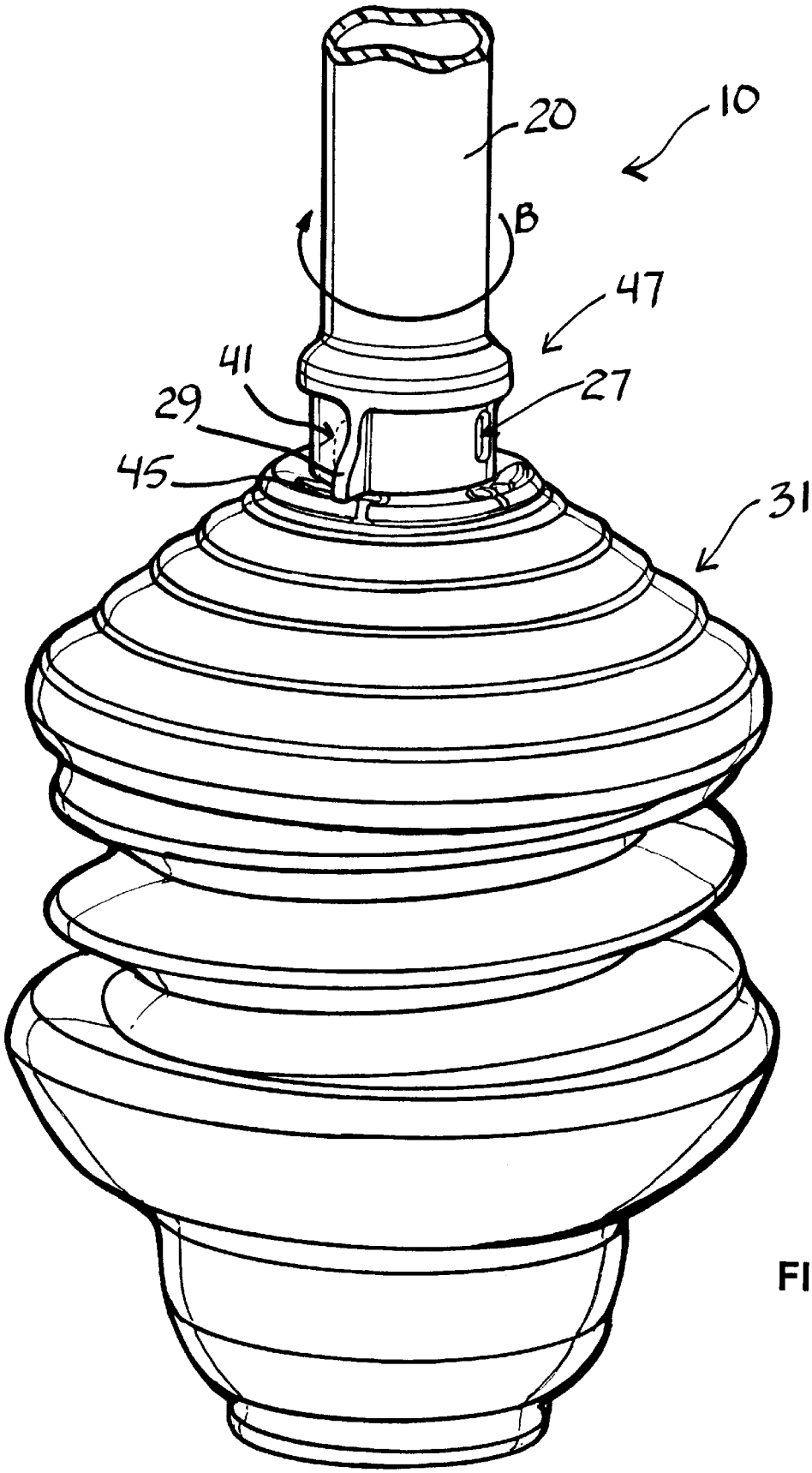
FIG. 8 is a partial perspective view of the present invention improved drain plunger showing the air vent mechanism in an air vent closed position.

Referring to FIGS. 6, 7, and 8, another preferred embodiment air vent mechanism 47 is provided. The air vent mechanism 47 includes vent openings 27 located along sides of the snap fitting receiver 25 and vent openings 41 located along the sides of the snap fitting component 39. Since the snap fitting receiver 25 rotates relative to the snap fitting component 39 (i.e. handle 20 and air chamber 31 when coupled together are still able to rotate relative to each other), vent openings 27 and vent openings 41 may be aligned to provide an air vent open position and may be offset to provide an air vent closed position. The air vent mechanism 47 further has a range limiting tab 29 located between the vent openings 27 that protrudes from a side of the snap fitting receiver 25. The air vent mechanism 47 also has an open stop 43 and a closed stop 45 located at a base perimeter 49 of the snap fitting component 39. The tab 29 is able to move between the open stop 43 and the closed stop 45.

Referring to FIG. 7, when the tab 29 is moved adjacent to and in contact with the open stop 43, then the vent openings 27 and 41 are aligned to the air vent open position to allow the release of air that exists within the spiral pleated collapsible air chamber 31 and the hollow handle 20. The tab 29 is moved to the open stop 43 by rotating the handle 20 in relation to the air chamber 31 in the direction shown by arrow A in FIG. 7. The release of the air and the smaller and compact structure of the spiral pleated collapsible air chamber 31 are provided to prevent overflow or excessive displacement of liquid when the plunger 10 is being initially inserted into the bowl or basin.

After the plunger 10 is initially inserted into the bowl or basin or other clogged liquid filled area and while the air vent mechanism 47 is still in the air vent open position, liquid fills into at least parts of an inner portion of the air chamber 31 and/or hollow handle 20. When the plunger 10 is being used to unclog a clogged drain (i.e. sealing nozzle 34 contacts a drain area), the tab 29 is moved adjacent to and in contact with the closed stop 45 by rotating the handle 20 in relation to the air chamber 31 in the direction shown by arrow B in FIG. 8. The vent openings 27 and 41 are offset from each other as shown in FIG. 8. When this offset of the vent openings 27 and 41 occurs, the air vent mechanism 47 is in the air vent closed position to prevent air and/or liquid from being released therefrom. Since the plunger 10 is filled with at least some liquid after being initially inserted therein, then liquid instead of air is being forced to the clogged area which helps prevent splashing of liquid and helps provide more effective and forceful plunging. The air vent mechanism 47 may be placed in the air vent open position and the air vent closed position as needed and desired by the user.

Referring to FIGS. 5 to 8, since the spiral pleated collapsible air chamber 31 has a spiral pleat 33 with only a few spirals, the inner portion of the spiral pleated collapsible air chamber 31 is relatively free from debris trapping areas or obstructive areas that may trap debris. Therefore, unsanitary debris from a clogged drain is less likely to become trapped within the spiral pleated collapsible air chamber 31 of the present invention during use. Also, the plunger 10 may be disassembled (i.e. the spiral pleated collapsible air chamber 31 is unscrewed and detached from the hollow handle 20) for easy cleaning and/or storage. When the plunger 10 with the spiral pleated collapsible air chamber 31 is being used, the spiral pleat 33 creates a vortex action of the liquid therein. The vortex action provides further downward and outward force and swirl (i.e. multi-direction) action to the clogged area to help break and dislodge the clogging debris therefrom. The vortex and swirl action also helps direct the debris towards the center and out of the air chamber 31 thereby further preventing debris from remaining or being trapped within spiral pleat 33 of the air chamber 31.

Figure 9:
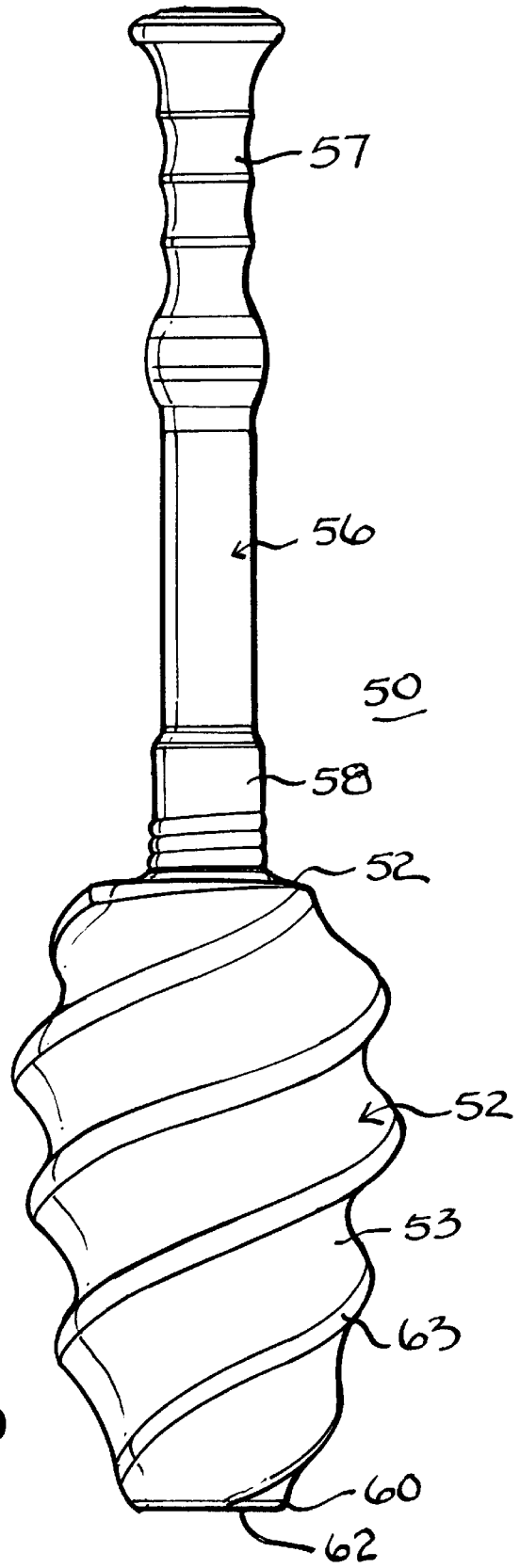
FIG. 9 is a side view of a drain plunger according to the present invention.

Turning now to FIG. 9, another embodiment of a plunger generally designated 50 is illustrated. Plunger 50 includes a chamber 52 having a continuous side wall 53 defining a void 54. An elongate handle 56 includes an end 57 forming a grip, and an end 58 removably coupled to an end of chamber 52. An opposing end of chamber 52 forms a nozzle 60 defining an opening 62 in communication with void 54. Side wall 53 includes a spiral pleat 63 encircling the void and movable between a compressed position and an expanded position. When compressed, the volume of chamber 52 is reduced, expelling water from chamber 52 through opening 62. The spiral pleat or more specifically, the helical pleats (triple helix in the preferred embodiment) of side wall 53 impart a vortex motion to water expelled from nozzle 60. The vortex action provides further downward and outward force and swirl (i.e. multi-direction) action to the clogged area to help break and dislodge the clogging debris therefrom. The vortex and swirl action also helps direct the debris towards the center of chamber 52 thereby further preventing debris from remaining or being trapped within spiral pleat 63 of chamber 52. It will be understood by those skilled in the art, that plunger 50 can include the venting described in previous embodiments.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated. Furthermore, the present invention is not in any way limited to the plunger configurations specifically disclosed in this specification. For example, the preferred embodiment air chambers and the preferred embodiment air vent mechanisms disclosed in this specification may be interchanged and used in any suitable combination or configuration.

What is claimed is:

1. A drain plunger comprising:

a chamber having a continuous side wall defining a void;

an elongate handle having a first end forming a grip, and a second end removably coupled to a first end of the chamber;

a second end of the chamber forming a nozzle defining an opening in communication with the void; and the side wall including a spiral pleat encircling the void and movable between a compressed position and an expanded position for imparting a vortex motion to water drawn through and expelled through the nozzle.

2. A drain plunger as claimed in claim 1 wherein the spiral pleat is helical.

3. A drain plunger as claimed in claim 2 wherein the side wall includes a plurality of helical pleats.

4. A drain plunger as claimed in claim 1 wherein the nozzle is semi-rigid, permitting deformation to sealing engage a drain.

5. A drain plunger as claimed in claim 1 wherein the second end of the handle is threadably engaged to the first end of the chamber.

6. A drain plunger as claimed in claim 1 wherein the handle is hollow and in communication with the void via an aperture formed in the first end of the chamber.

7. A drain plunger as claimed in claim 6 further including a closable aperture formed in the handle in communication with the void via the hollow handle.

8. A drain as claimed in claim 7 wherein the aperture is formed proximate the first end of the handle.

9. A drain plunger as claimed in claim 2 wherein the side wall includes a plurality of helical pleats.

10. A drain plunger comprising:

an elongate handle having a first end and a second end;

a generally cylindrical chamber having a continuous side wall defining a void;

a first end of the chamber coupled to the second end of the handle;

a second end of the chamber forming a nozzle defining an opening in communication with the void; and a spiral pleat formed in the side wall intermediate the first end of the chamber and the second end of the chamber, the spiral encircling the void and movable between a compressed position and an expanded position to impart a vortex motion to water passing through the opening.

11. A drain plunger as claimed in claim 10 wherein the spiral pleat is helical.

12. A drain plunger as claimed in claim 10 wherein the nozzle is semi-rigid, permitting deformation to sealing engage a drain.

13. A drain plunger as claimed in claim 10 wherein the second end of the handle is threadably engaged to the first end of the chamber.

14. A drain plunger as claimed in claim 10 wherein the handle is hollow and in communication with the void via an aperture formed in the first end of the chamber.

15. A drain plunger as claimed in claim 14 further including a closable aperture formed in the handle in communication with the void via the hollow handle.

16. A drain as claimed in claim 15 wherein the aperture is formed proximate the first end of the handle.

* * * * *